US011643818B1

(12) United States Patent
Attalla

(10) Patent No.: US 11,643,818 B1
(45) Date of Patent: May 9, 2023

(54) STIFF WALL PANEL ASSEMBLY FOR A BUILDING STRUCTURE AND ASSOCIATED METHOD(S)

(71) Applicant: Anthony Attalla, Navarre, FL (US)

(72) Inventor: Anthony Attalla, Navarre, FL (US)

( * ) Notice: Subject to any disclaimer, the term of this patent is extended or adjusted under 35 U.S.C. 154(b) by 0 days.

(21) Appl. No.: 18/055,448

(22) Filed: Nov. 15, 2022

Related U.S. Application Data

(60) Provisional application No. 63/368,450, filed on Jul. 14, 2022.

(51) Int. Cl.
*E04C 2/38* (2006.01)
*E04C 2/08* (2006.01)
*E04C 2/32* (2006.01)

(52) U.S. Cl.
CPC ..... *E04C 2/384* (2013.01); *E04C 2/08* (2013.01); *E04C 2/32* (2013.01)

(58) Field of Classification Search
CPC ..... E04C 2/08; E04C 2/32; E04C 2/384
USPC ..... 52/798.1
See application file for complete search history.

(56) References Cited

U.S. PATENT DOCUMENTS 3,037,590 A * 6/1962 Pavlecka ..... E04C 2/08 52/592.1
3,191,726 A * 6/1965 Pavlecka ..... F16B 5/07 52/561
3,296,759 A * 1/1967 Pavlecka ..... B62D 31/02 52/234
4,674,250 A * 6/1987 Altizer ..... E04B 1/14 52/309.7
4,748,781 A * 6/1988 Wencley ..... E04C 2/386 52/801.1
4,809,476 A * 3/1989 Satchell ..... E04B 2/76 52/843
4,843,780 A * 7/1989 Krings ..... E02D 17/04 52/798.1
4,918,899 A * 4/1990 Karytinos ..... E04B 1/5818 52/690
5,081,813 A * 1/1992 White ..... E04B 2/7457 52/656.1
5,619,837 A * 4/1997 DiSanto ..... E04C 2/384 52/630
6,374,558 B1 * 4/2002 Surowiecki ..... E04B 2/7457 52/690
6,381,916 B1 * 5/2002 Maisch ..... E04C 3/07 52/717.06

(Continued)

*Primary Examiner* — Brian D Mattei
*Assistant Examiner* — Joseph J. Sadlon
(74) *Attorney, Agent, or Firm* — Ashkan Najafi

(57) ABSTRACT

A stiff wall panel assembly includes a wall panel including a single, continuous, and unitary layer including a central portion having a plurality of central portion ribs spaced therealong, a first wall track engaged with the central portion and having a plurality of first ribs spaced therealong, and a second wall track engaged with the central portion and having a plurality of second ribs spaced therealong. Studs are engaged with the central portion, the first wall track, and the second wall track. Such studs have a plurality of third ribs each engaged with the central portion ribs, the first ribs, and the second ribs. The first ribs and the second ribs each are linearly interlocked as well as linearly and slidably interfitted within the third ribs of the studs. The first ribs and the second ribs each are parallel to the third ribs of the studs.

14 Claims, 14 Drawing Sheets

(56) References Cited

U.S. PATENT DOCUMENTS

| | | | | |
|---|---|---|---|---|
| 6,968,661 | B2 * | 11/2005 | Kopish | E04B 2/7457 52/745.1 |
| 7,127,862 | B2 * | 10/2006 | Saldana | E04B 2/767 52/481.1 |
| 7,178,304 | B2 * | 2/2007 | Brady | E04B 2/7457 52/653.1 |
| 8,225,581 | B2 * | 7/2012 | Strickland | E04C 3/07 52/855 |
| 8,615,959 | B2 * | 12/2013 | Ferguson | E04B 2/767 52/653.1 |
| 10,016,056 | B2 * | 7/2018 | Sklansky | A47B 47/0008 |
| 10,480,185 | B1 * | 11/2019 | Attalla | E04B 2/767 |
| 10,822,793 | B2 * | 11/2020 | Yu | E04C 2/384 |
| 2007/0011971 | A1 * | 1/2007 | Sitkiewicz | E04B 2/767 52/481.1 |
| 2008/0016802 | A1 * | 1/2008 | Rheaume | E04C 2/26 52/220.1 |
| 2012/0144774 | A1 * | 6/2012 | Andrews | E04B 2/7411 52/656.9 |
| 2020/0095767 | A1 * | 3/2020 | Attalla | E04C 3/32 |

* cited by examiner

STIFF WALL PANEL ASSEMBLY FOR A BUILDING STRUCTURE AND ASSOCIATED METHOD(S)

CROSS REFERENCE TO RELATED APPLICATIONS

This is a non-provisional patent application that claims priority to and benefit of U.S. provisional patent application No. 63/368,450 filed Jul. 14, 2022, which is incorporated by reference herein in its entirety.

STATEMENT REGARDING FEDERALLY SPONSORED RESEARCH OR DEVELOPMENT

Not Applicable.

REFERENCE TO A MICROFICHE APPENDIX

Not Applicable.

BACKGROUND

Technical Field

Exemplary embodiment(s) of the present disclosure relate to wall panel assemblies and, more particularly, to a specially configured steel stiff wall panel assembly for providing improved resistance to shear forces, racking forces, and impact forces.

Prior Art

Stick frame construction or simply stick construction is used for a large portion of the frame of a building, is used in a large percentage of smaller scale building construction projects. Stick construction utilizes studs, lightweight materials, typically either wood or metal, to construct the frame, including walls, floor joists and roof trusses of the building under construction, wood studs being typical in residential construction and metal studs being typical in commercial construction. Stick frame construction produces a building frame that has a relatively high strength to weight ratio.

While a strong frame can be produced using standard stick frame construction, there is room for improvement. One issue building design engineers grapple with is trying to increase the shear strength of the frame built, especially, the vertical or wall components of the frame. A stick frame constructed building is subject to in plane lateral forces, caused by wind and earthquakes. If such in plane force is sufficiently strong, the building can be subject to racking, wherein the walls of the building come out of square. Racking causes damage to carious components of the building, including the walls, both interior and exterior, cabinets, doors and windows, flooring, especially upper story flooring, and in extreme cases, structural failure.

In wood stick frame construction, engineers focus on the strength of the wood used to produce the stud as well as bracing the frame and the walls via sheathing and other methods, in order to increase the shear strength of the structure built in order to thereby reduce the potential for racking. In addition to these considerations, in metal stick construction, engineers also focus on the geometry of the frame, particularly the stud, to increase the overall shear strength of the stud and thereby increase overall shear strength of the frame produced.

Accordingly, a need remains for an improved wall panel assembly in order to overcome at least one of the above-noted shortcomings. The exemplary embodiment(s) satisfy such a need by a specially configured steel stiff wall panel assembly that is convenient and easy to use, lightweight yet durable in design, versatile in its applications, and designed for providing improved resistance to shear forces, racking forces, and impact forces

BRIEF SUMMARY OF NON-LIMITING EXEMPLARY EMBODIMENT(S) OF THE PRESENT DISCLOSURE

In view of the foregoing background, it is therefore an object of the non-limiting exemplary embodiment(s) to provide a specially configured steel stiff wall panel assembly for providing improved resistance to shear forces, racking forces, and impact forces. These and other objects, features, and advantages of the non-limiting exemplary embodiment(s) are provided by a stiff wall panel assembly for a building structure including a wall panel including a single, continuous, and unitary layer extended along an entire surface area of the wall panel. Such a single, continuous, and unitary layer includes a central portion having a plurality of central portion ribs spaced therealong, a first wall track engaged with the central portion and having a plurality of first ribs spaced therealong, and a second wall track engaged with the central portion and having a plurality of second ribs spaced therealong. A plurality of studs are engaged with the central portion, the first wall track, and the second wall track. Such studs have a plurality of third ribs each engaged with the central portion ribs, the first ribs, and the second ribs. Advantageously, the first ribs and the second ribs each are linearly interlocked as well as linearly and slidably interfitted within the third ribs of the studs. Advantageously, the first ribs and the second ribs each are parallel to the third ribs of the studs. Notably, the first ribs and the second ribs each having a longitudinal length shorter than a longitudinal length of the third ribs of the studs.

In a non-limiting exemplary embodiment, the first wall track is oriented parallel to the second wall track.

In a non-limiting exemplary embodiment, the central portion ribs are integral with the central portion and linearly extended therealong.

In a non-limiting exemplary embodiment, the central portion ribs are parallel to the first ribs, the second ribs, and the third ribs.

In a non-limiting exemplary embodiment, the central portion ribs are linearly interlocked as well as linearly and slidably interfitted with the third ribs of the studs.

In a non-limiting exemplary embodiment, the central portion ribs are orthogonal to the first ribs, the second ribs, and the third ribs.

In a non-limiting exemplary embodiment, a plurality of fasteners connected to a plurality of intersecting junctures of the central portion ribs and the third ribs of the studs, respectively.

In a non-limiting exemplary embodiment, the central portion is integral and monolithic with the first wall track and the second wall track.

In a non-limiting exemplary embodiment, each of the first wall track and the second wall track having a single stiffening leg longitudinally extended orthogonal to the studs and oppositely spaced from the central portion. Advantageously, the first ribs and the second ribs are located at the single stiffening leg, respectively.

In a non-limiting exemplary embodiment, the central portion is separate from and detachably coupled to each of the first wall track and the second wall track.

In a non-limiting exemplary embodiment, the central portion has a first tongue and a second tongue located at opposed perimeter edges of the central portion. Advantageously, each of the first tongue and the second tongue is rectilinear and parallel to the central portion ribs, respectively.

In a non-limiting exemplary embodiment, each of the first wall track and the second wall track has a pair of stiffening legs longitudinally extended orthogonal to the studs. Advantageously, a first one of the stiffening legs is directly connected to the central wall panel and a second one of the stiffening legs is oppositely spaced from the central wall panel. In this manner, the first ribs of the first wall track and the second ribs of the second wall track are located at the first one and the second one of the stiffening legs associated with each of the first wall track and the second wall track, respectively.

There has thus been outlined, rather broadly, the more important features of non-limiting exemplary embodiment(s) of the present disclosure so that the following detailed description may be better understood, and that the present contribution to the relevant art(s) may be better appreciated. There are additional features of the non-limiting exemplary embodiment(s) of the present disclosure that will be described hereinafter and which will form the subject matter of the claims appended hereto.

BRIEF DESCRIPTION OF THE NON-LIMITING EXEMPLARY DRAWINGS

The novel features believed to be characteristic of non-limiting exemplary embodiment(s) of the present disclosure are set forth with particularity in the appended claims. The non-limiting exemplary embodiment(s) of the present disclosure itself, however, both as to its organization and method of operation, together with further objects and advantages thereof, may best be understood by reference to the following description taken in connection with the accompanying drawings in which:

Figure 1:
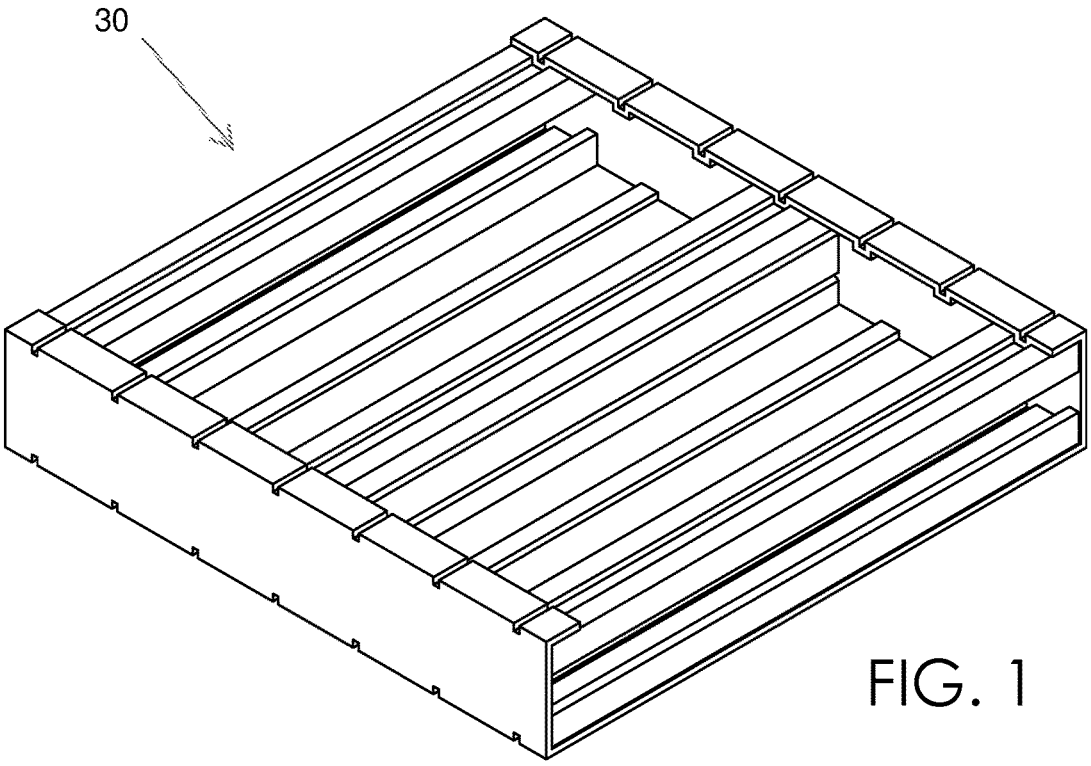
FIG. 1 is a perspective view of a stiff wall panel assembly wherein the wall panel is detachable form the tracks, each having ribs parallel to the studs, in accordance with a non-limiting exemplary embodiment of the present disclosure.
Figure 2:
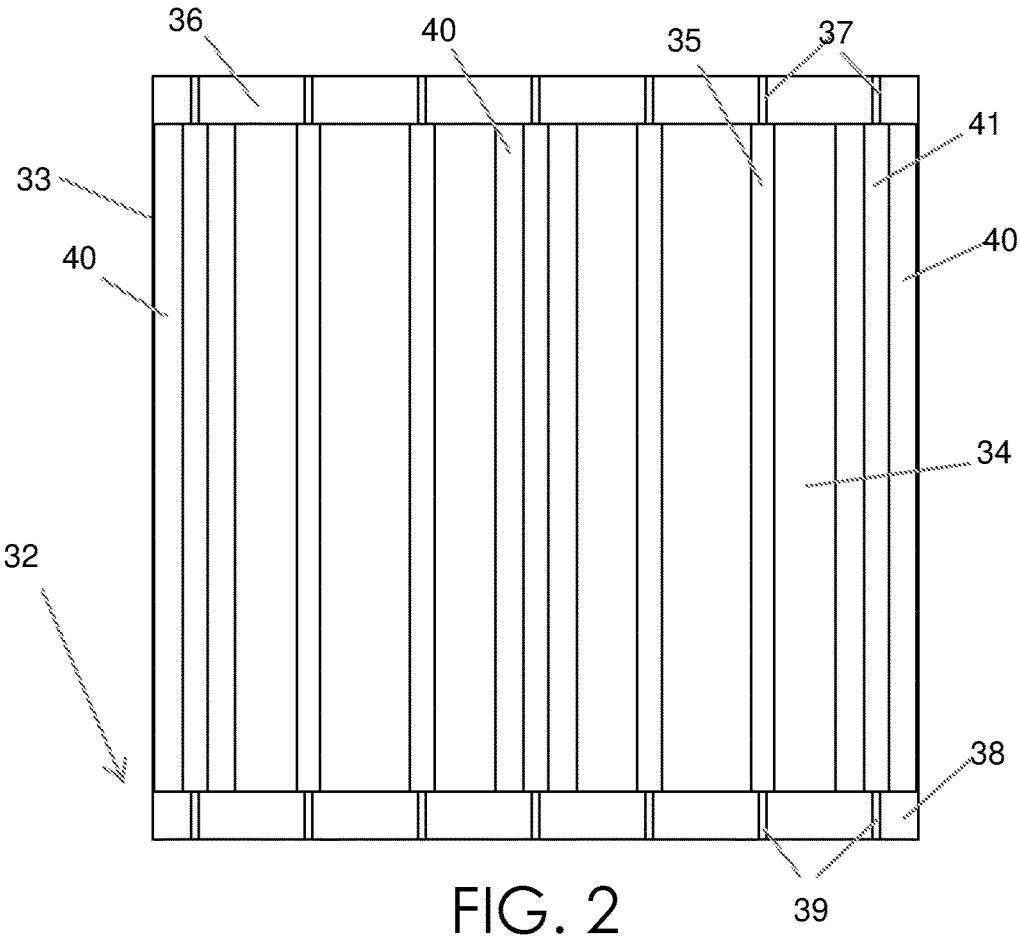
FIG. 2 is a rear elevational view of the stiff wall panel assembly shown in FIG. 1, in accordance with a non-limiting exemplary embodiment of the present disclosure.
Figure 3:
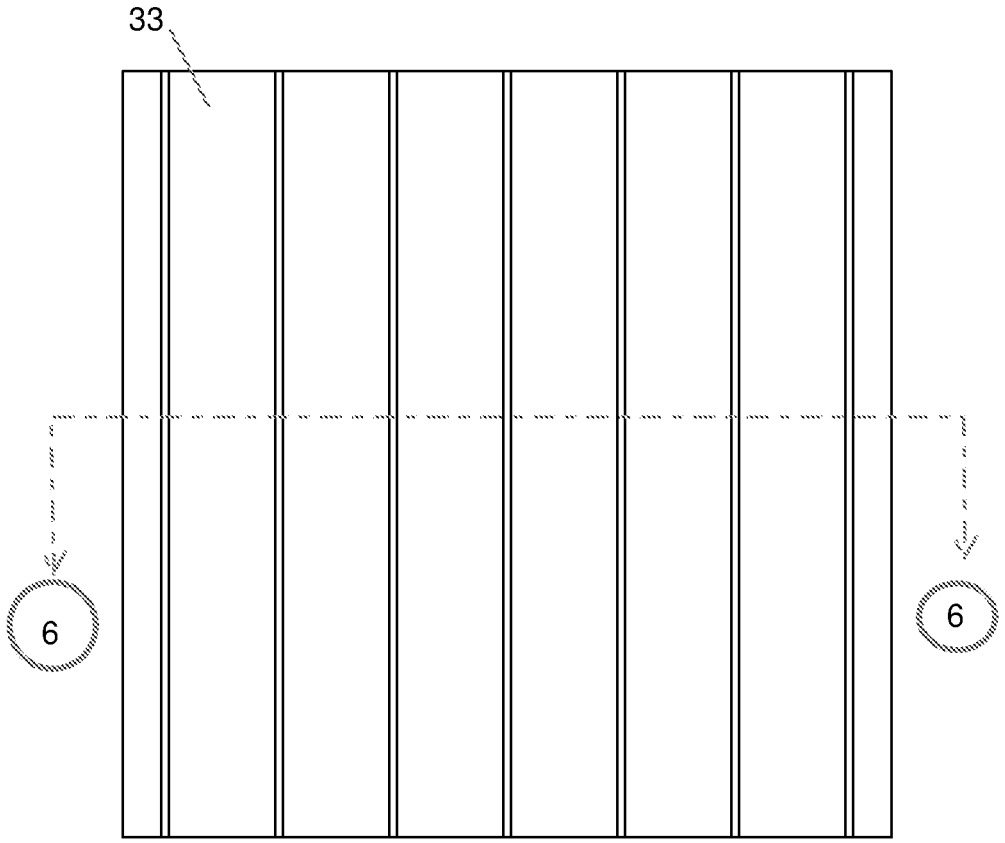
FIG. 3 is a front elevational view of the stiff wall panel assembly shown in FIG. 1, in accordance with a non-limiting exemplary embodiment of the present disclosure.
Figure 4:
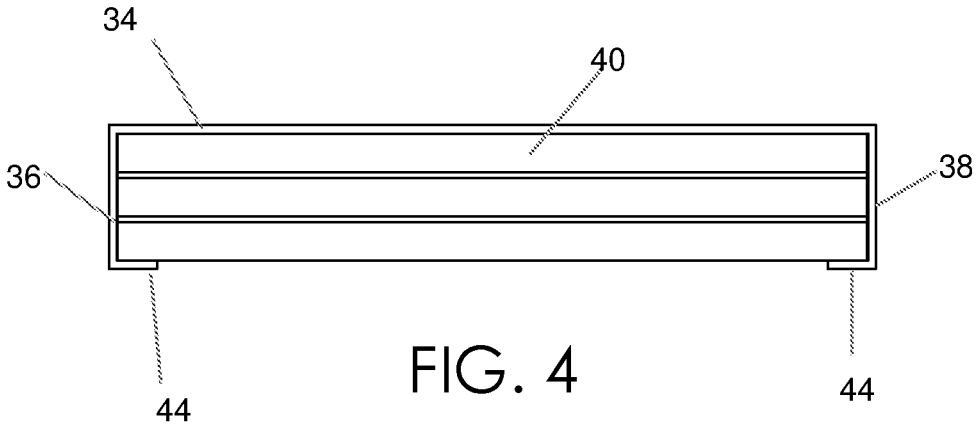
FIG. 4 is a side elevational view of the stiff wall panel assembly shown in FIG. 1, in accordance with a non-limiting exemplary embodiment of the present disclosure.
Figure 5:
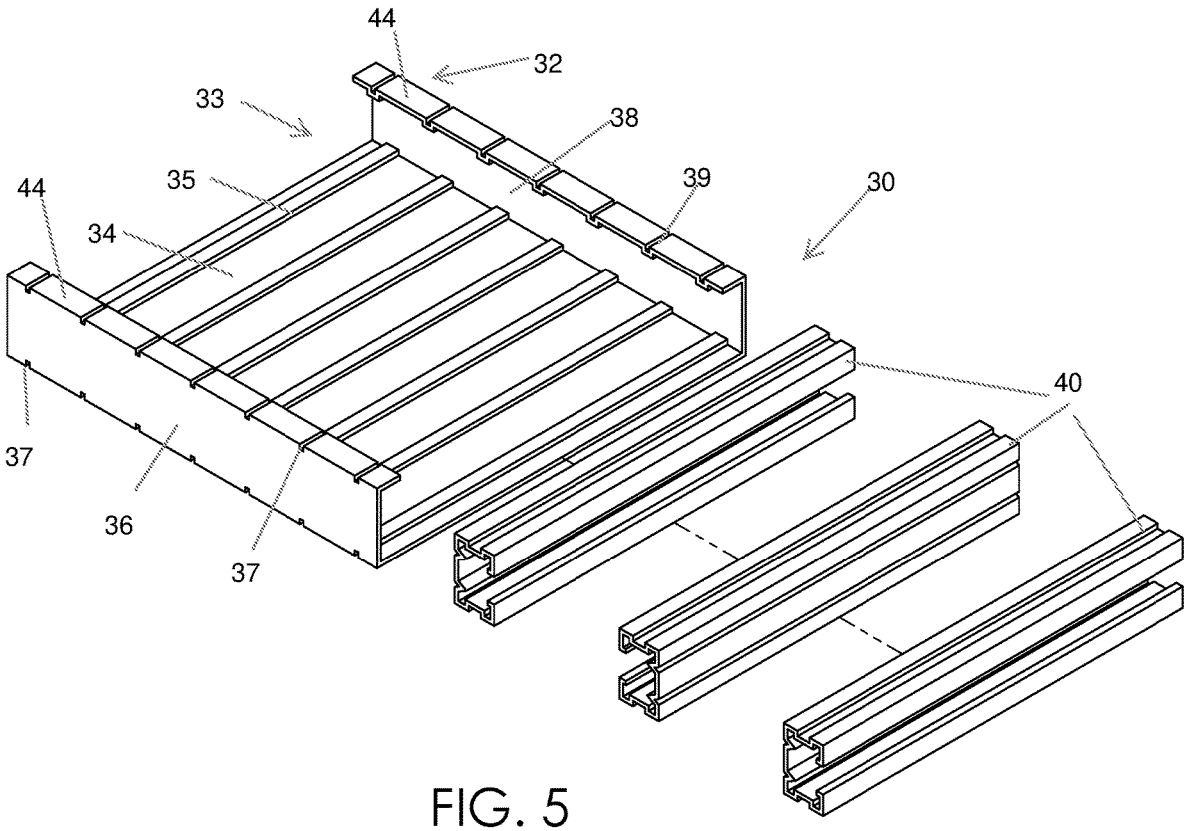
FIG. 5 is an exploded view of the stiff wall panel assembly shown in FIG. 1, in accordance with a non-limiting exemplary embodiment of the present disclosure.
Figure 6:
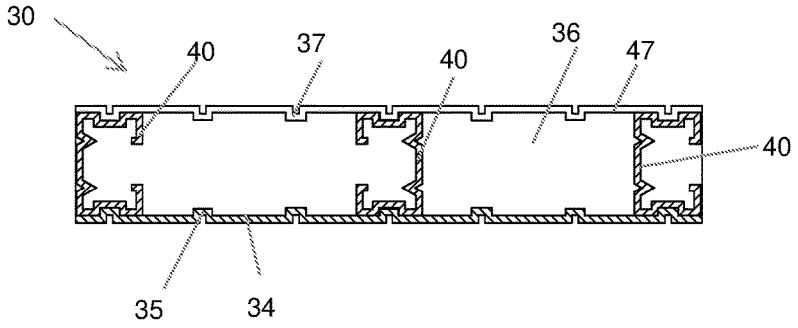
FIG. 6 is a cross-sectional view taken along line 6-6 in FIG. 3, in accordance with a non-limiting exemplary embodiment of the present disclosure.
Figure 7:
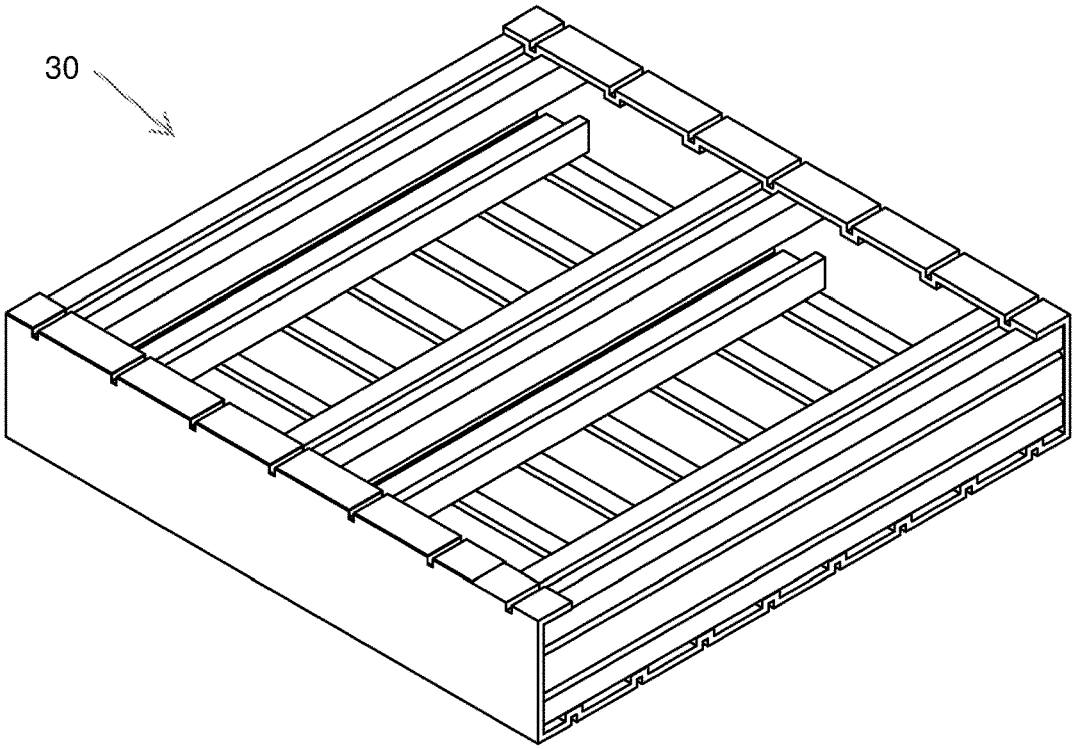
FIG. 7 is a perspective view of a stiff wall panel assembly wherein the wall panel is detachable from the tracks, each having ribs orthogonal and parallel to the studs, respectively, in accordance with a non-limiting exemplary embodiment of the present disclosure.
Figure 8:
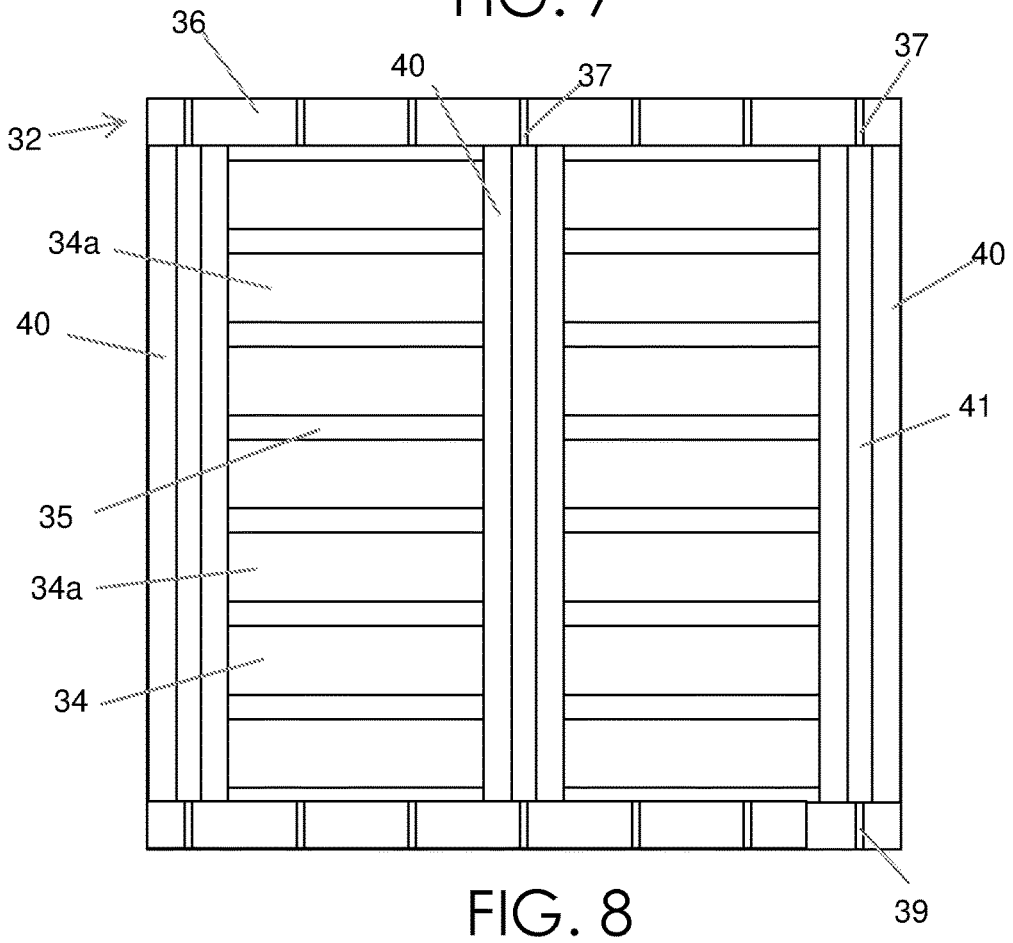
FIG. 8 is a rear elevational view of the stiff wall panel assembly shown in FIG. 7, in accordance with a non-limiting exemplary embodiment of the present disclosure.
Figure 9:
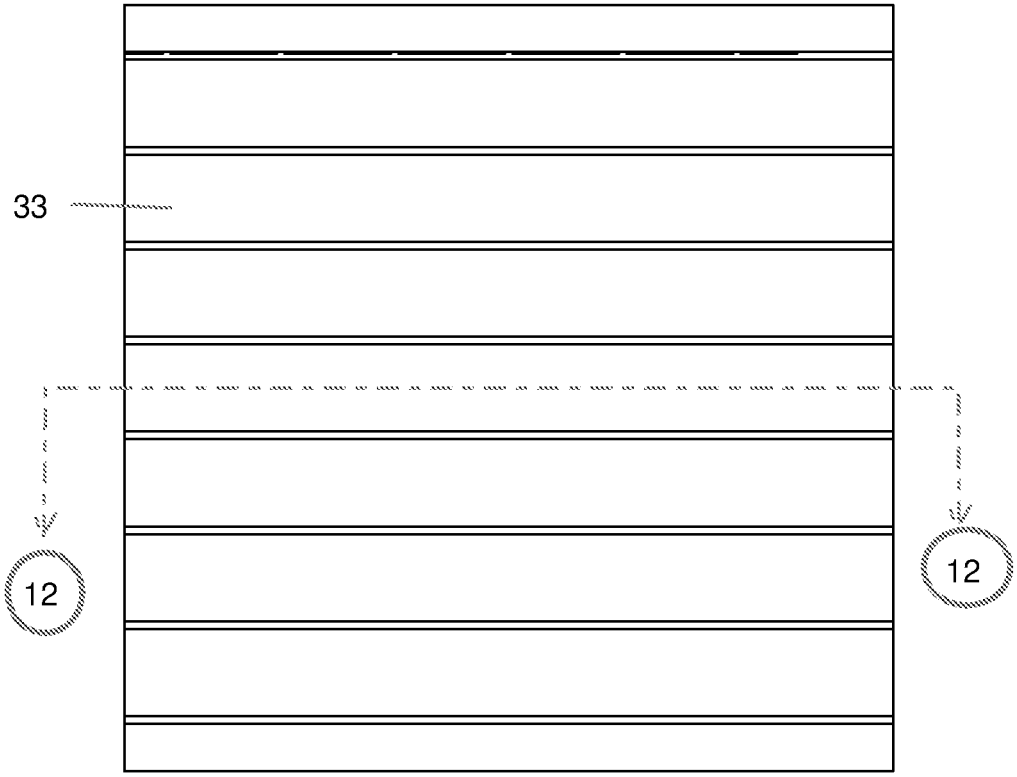
FIG. 9 is a front elevational view of the stiff wall panel assembly shown in FIG. 7, in accordance with a non-limiting exemplary embodiment of the present disclosure.
Figure 10:
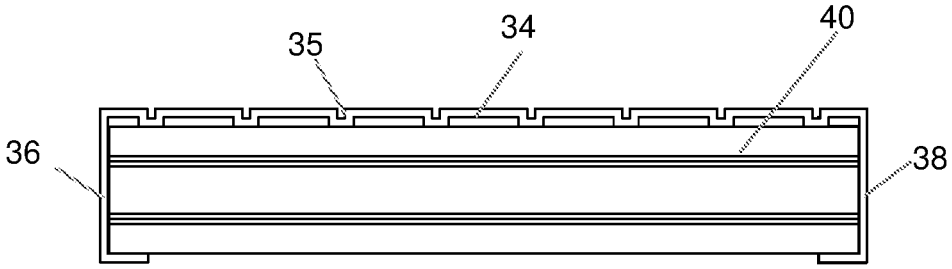
FIG. 10 is a side elevational view of the stiff wall panel assembly shown in FIG. 7, in accordance with a non-limiting exemplary embodiment of the present disclosure.
Figure 11:
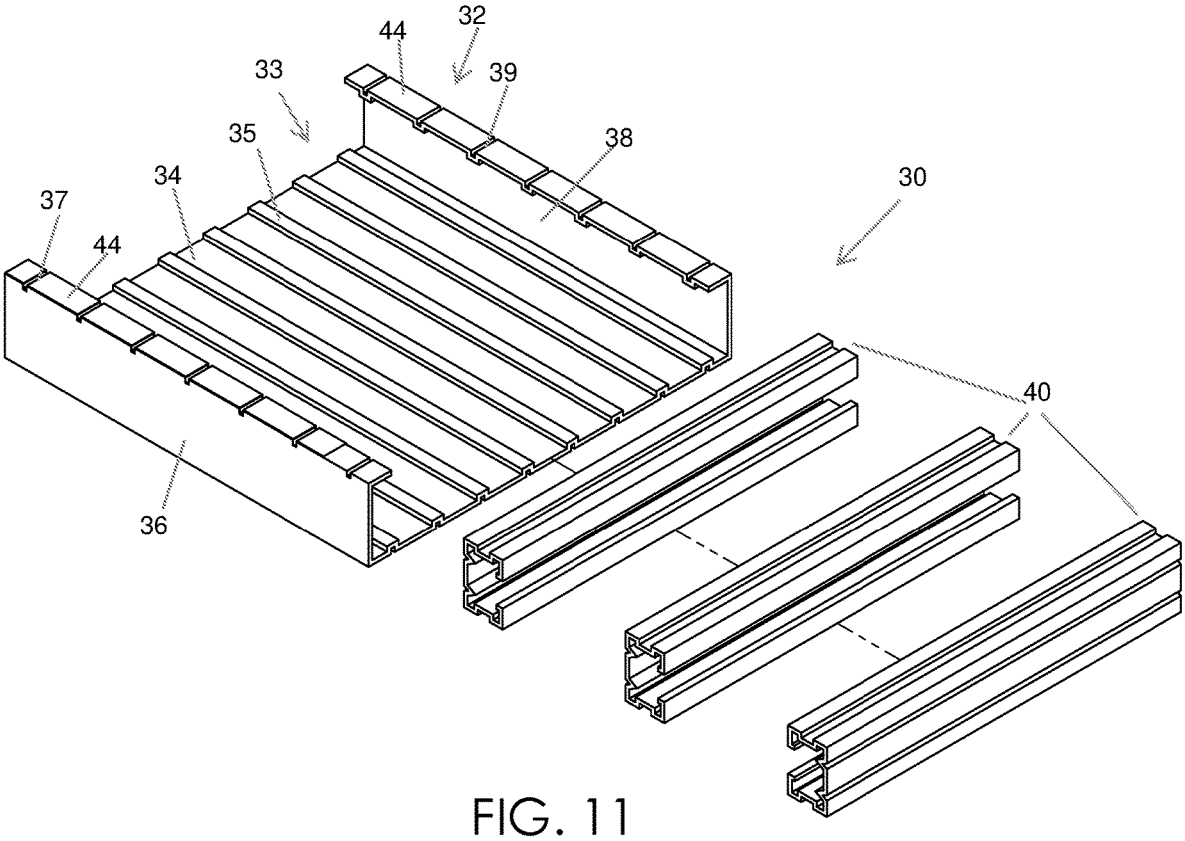
FIG. 11 is an exploded view of the stiff wall panel assembly shown in FIG. 7, in accordance with a non-limiting exemplary embodiment of the present disclosure.
Figure 12:
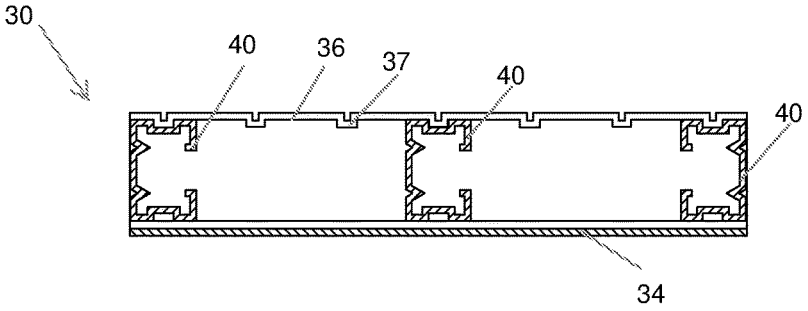
FIG. 12 is a cross-sectional view taken along line 12-12 in FIG. 9, in accordance with a non-limiting exemplary embodiment of the present disclosure.
Figure 13:
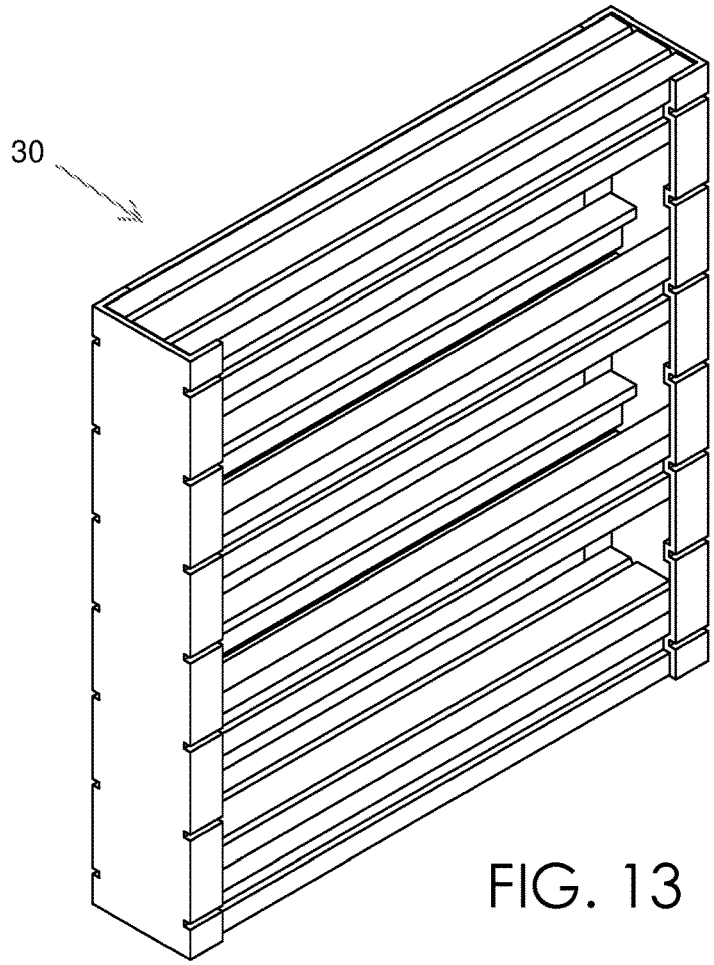
FIG. 13 is a perspective view of a stiff wall panel assembly wherein the wall panel is detachable from the tracks, each having ribs parallel to the studs, in accordance with a non-limiting exemplary embodiment of the present disclosure.
Figure 14:
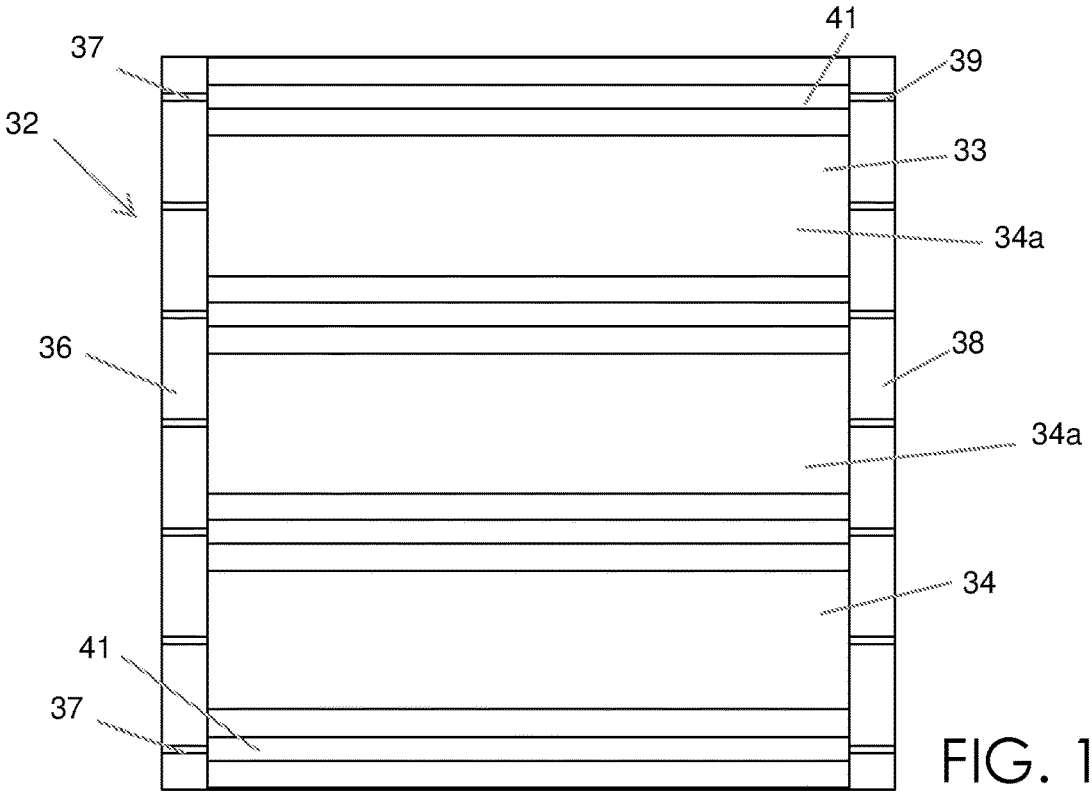
FIG. 14 is a rear elevational view of the stiff wall panel assembly shown in FIG. 13, in accordance with a non-limiting exemplary embodiment of the present disclosure.
Figure 15:
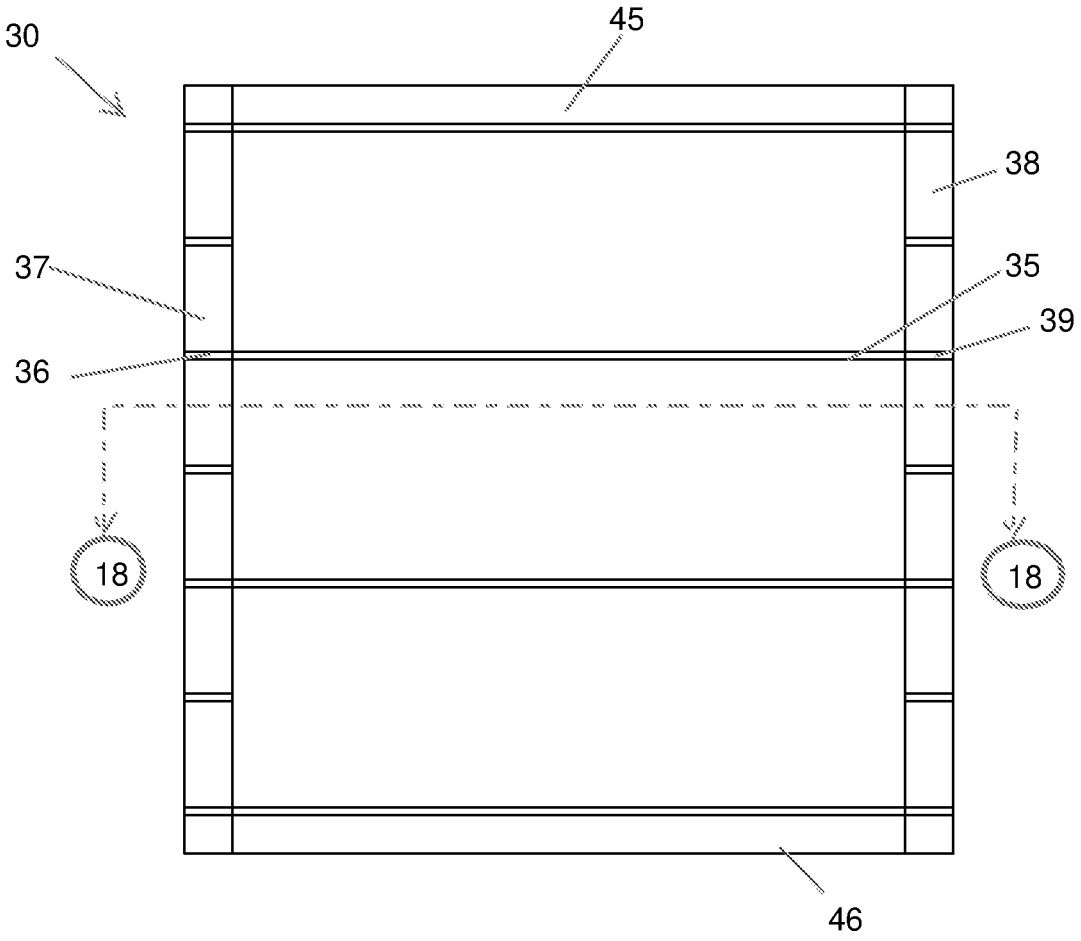
FIG. 15 is a front elevational view of the stiff wall panel assembly shown in FIG. 13, in accordance with a non-limiting exemplary embodiment of the present disclosure.
Figure 16:
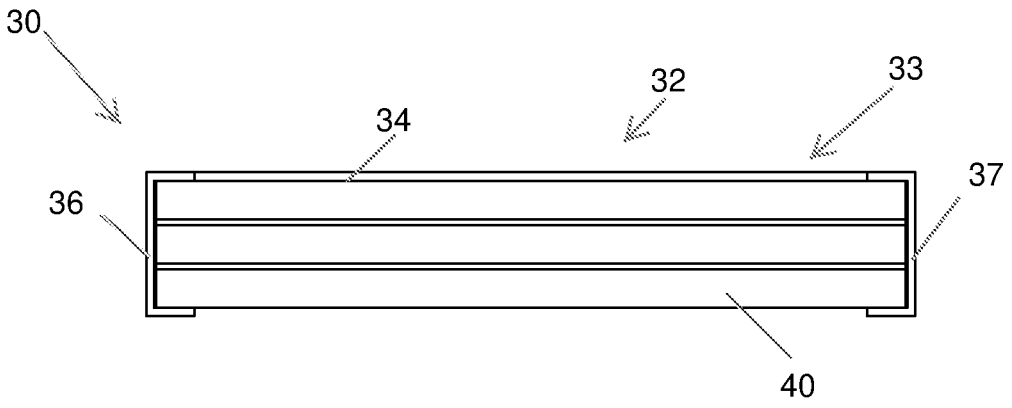
FIG. 16 is a top plan view of the stiff wall panel assembly shown in FIG. 13, in accordance with a non-limiting exemplary embodiment of the present disclosure.
Figure 17:
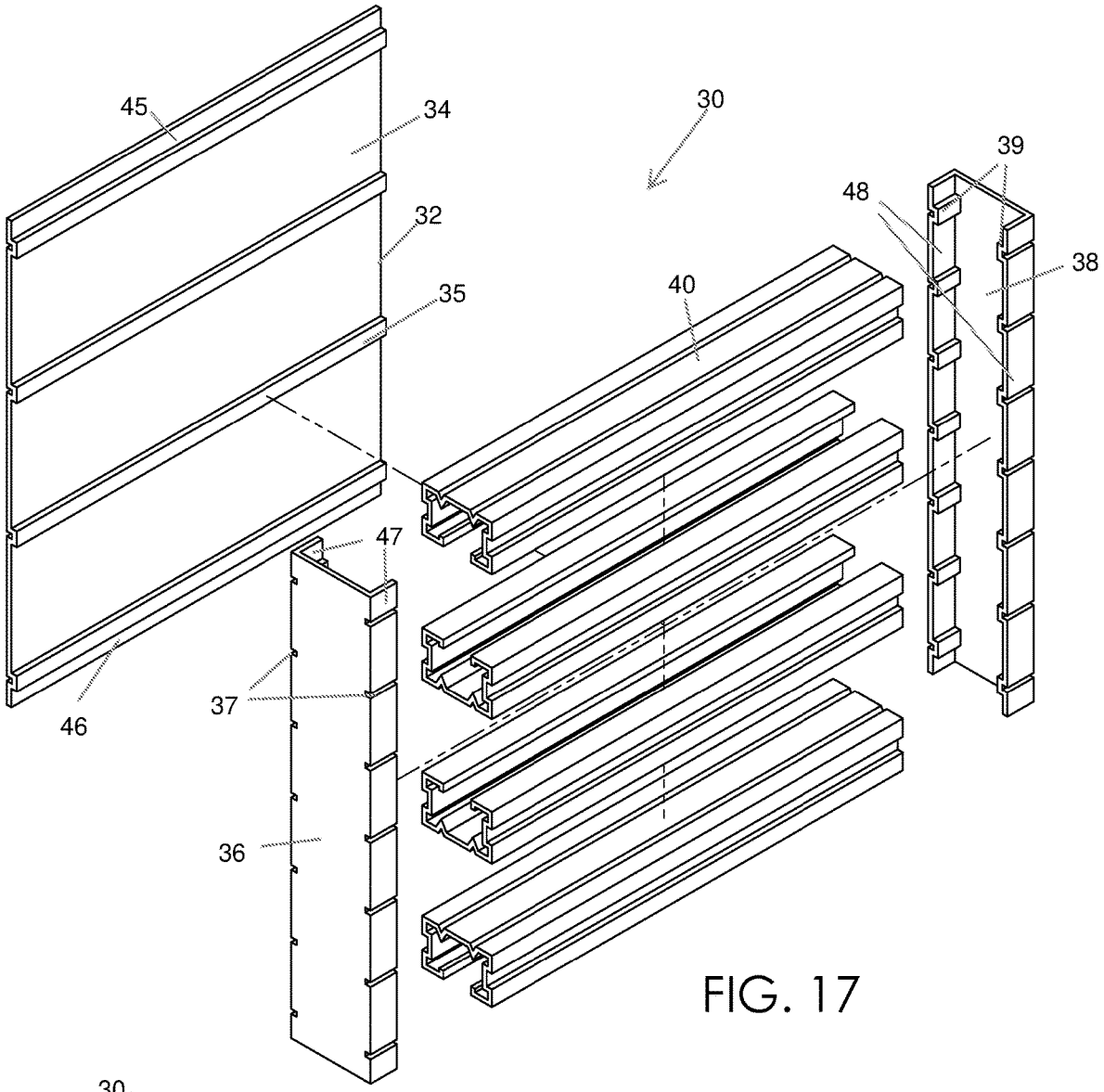
FIG. 17 is an exploded view of the stiff wall panel assembly shown in FIG. 13, in accordance with a non-limiting exemplary embodiment of the present disclosure.
Figure 18:
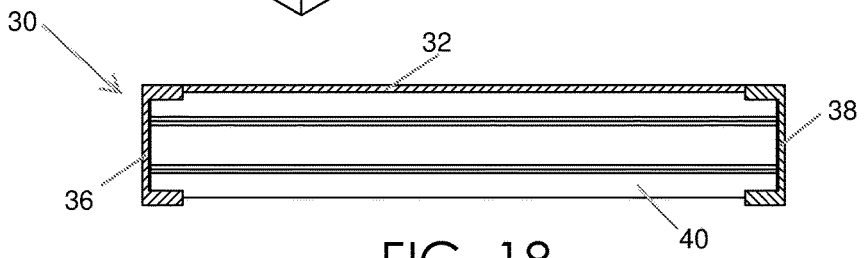
FIG. 18 is a cross-sectional view taken along line 18-18 in FIG. 15, in accordance with a non-limiting exemplary embodiment of the present disclosure.
Figure 19:
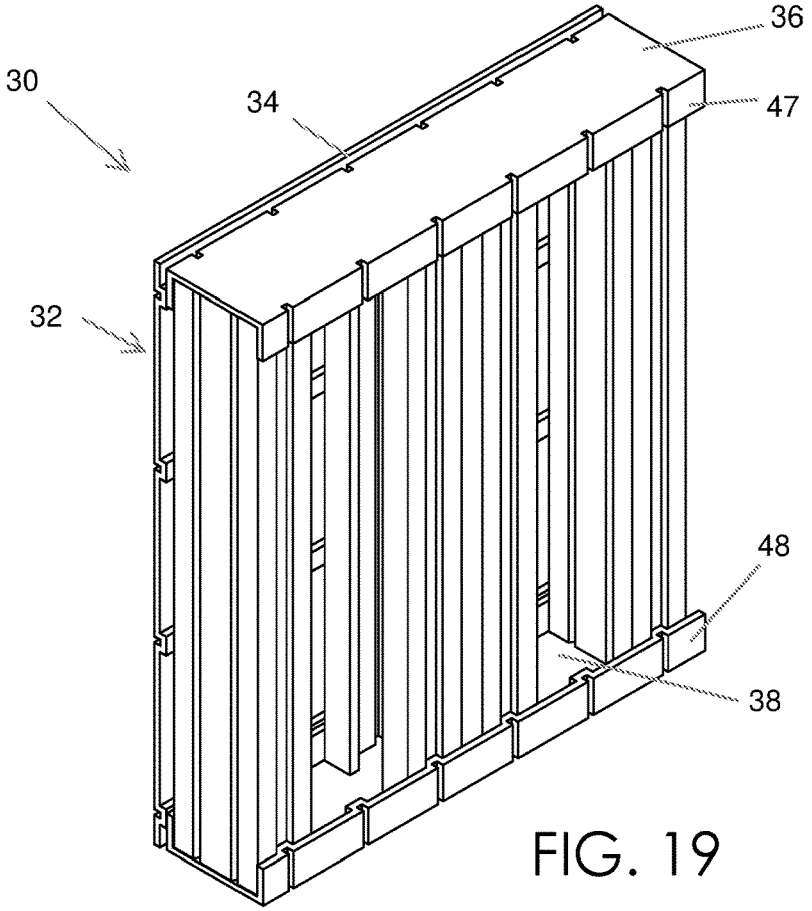
FIG. 19 is a perspective view of a stiff wall panel assembly wherein the wall panel is detachable from the tracks, each having ribs orthogonal and parallel to the studs, respectively, in accordance with a non-limiting exemplary embodiment of the present disclosure.
Figure 20:
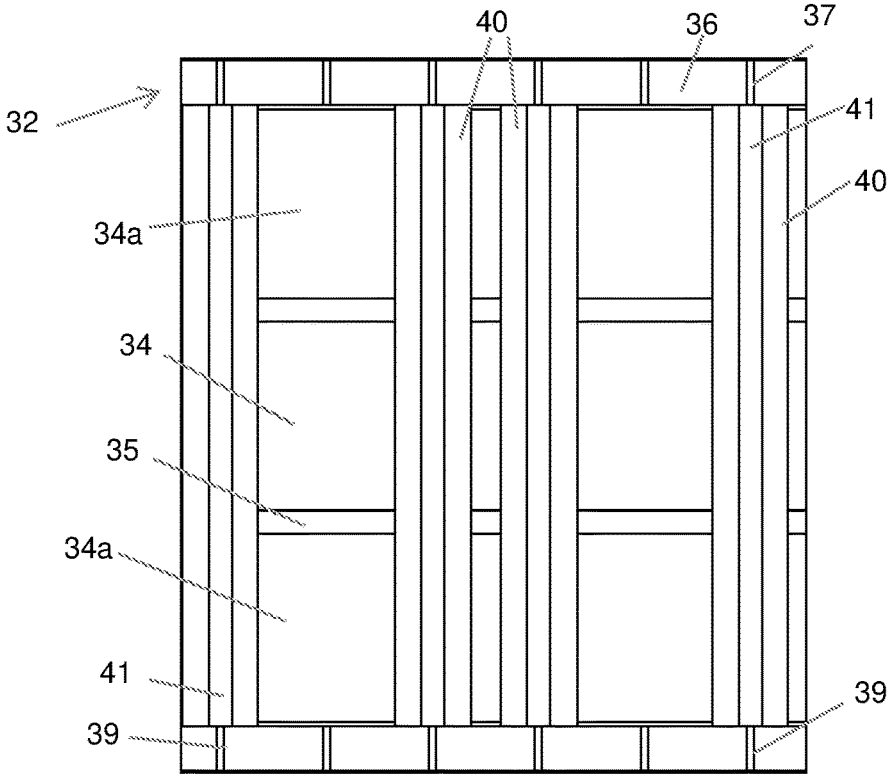
FIG. 20 is a rear elevational view of the stiff wall panel assembly shown in FIG. 19, in accordance with a non-limiting exemplary embodiment of the present disclosure.
Figure 21:
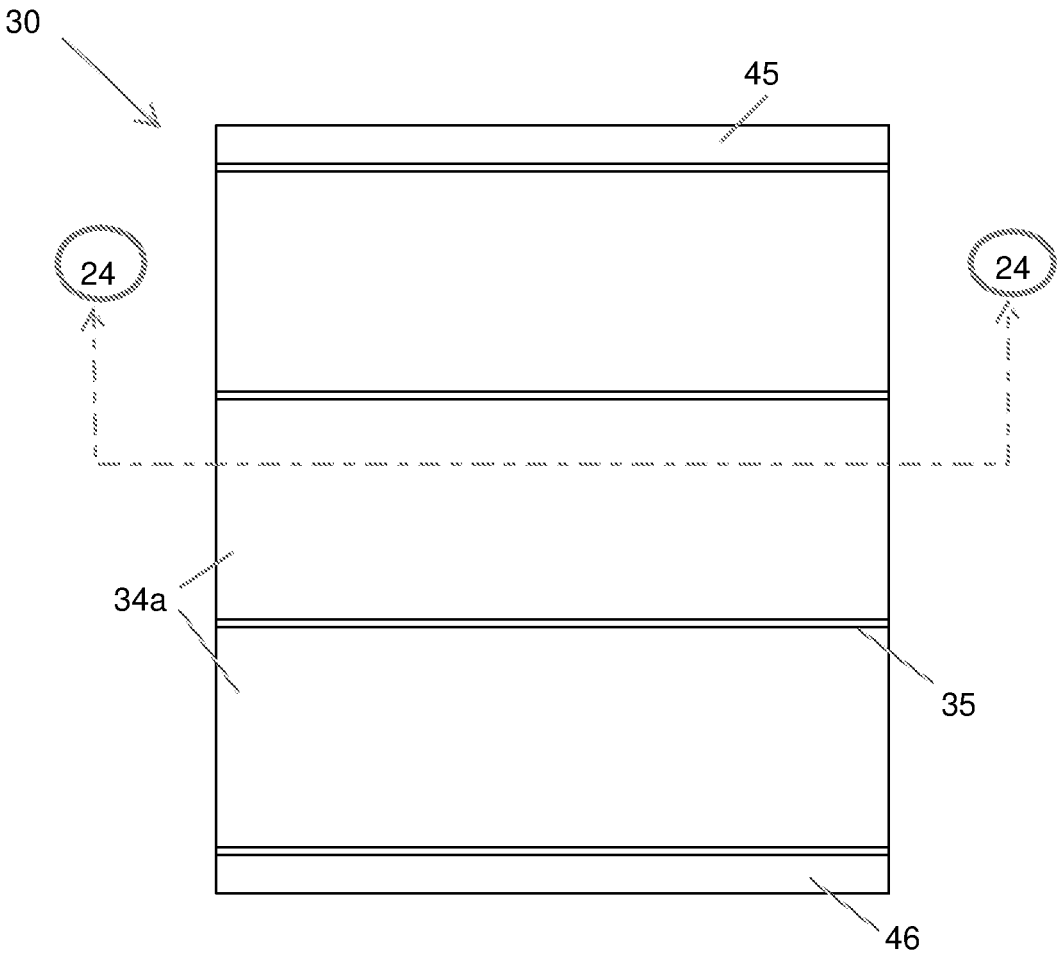
FIG. 21 is a front elevational view of the stiff wall panel assembly shown in FIG. 19, in accordance with a non-limiting exemplary embodiment of the present disclosure.
Figure 22:
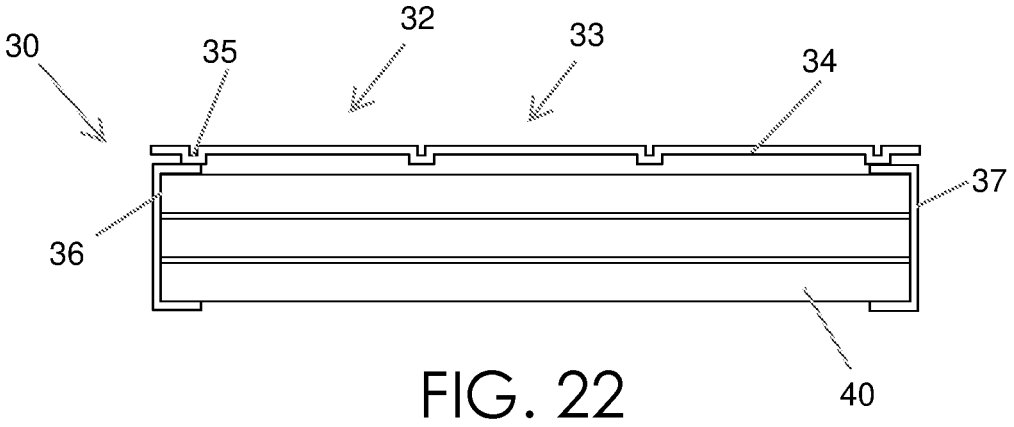
FIG. 22 is a side elevational view of the stiff wall panel assembly shown in FIG. 19, in accordance with a non-limiting exemplary embodiment of the present disclosure.
Figure 23:
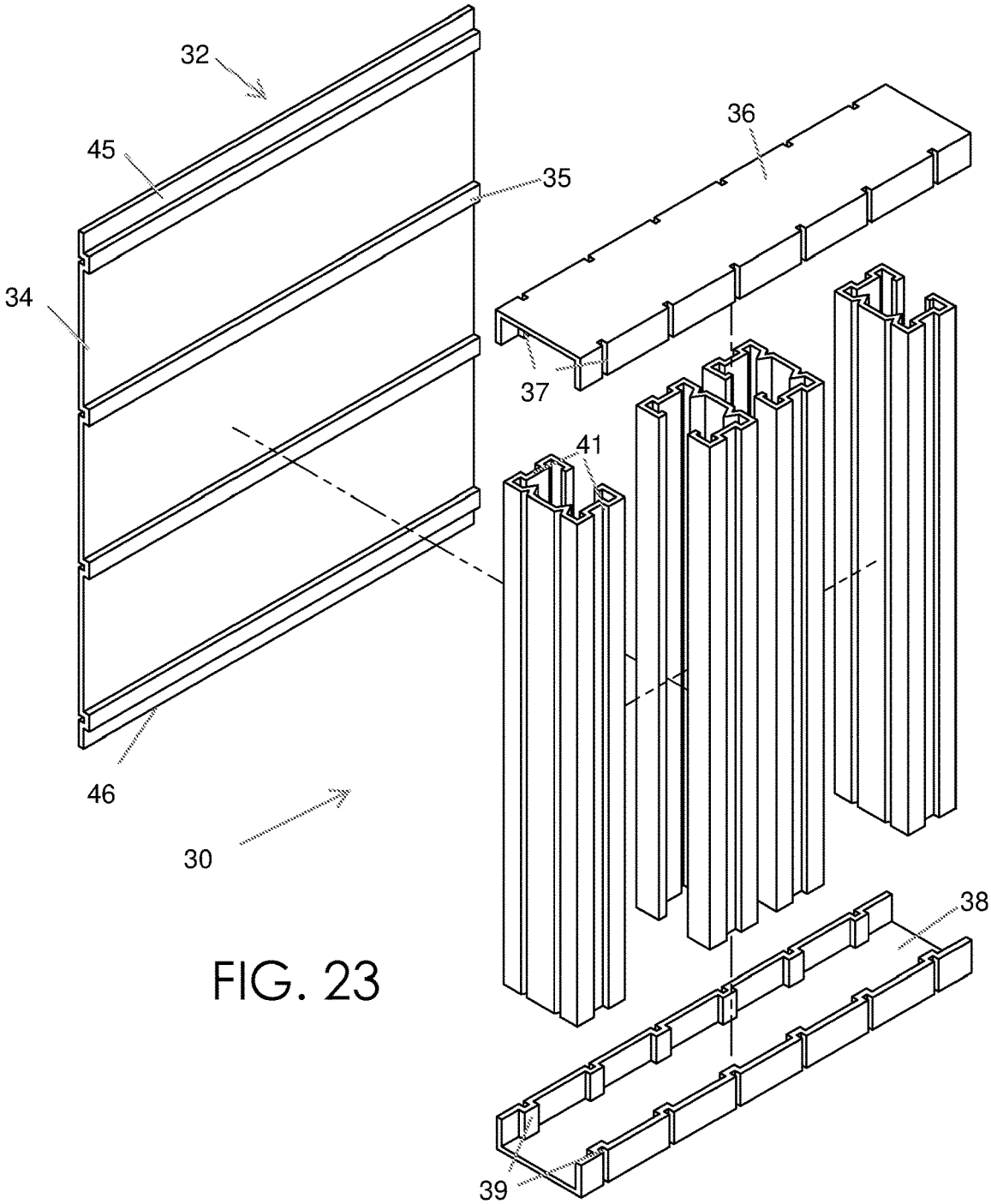
FIG. 23 is an exploded view of the stiff wall panel assembly shown in FIG. 19, in accordance with a non-limiting exemplary embodiment of the present disclosure.
Figure 24:
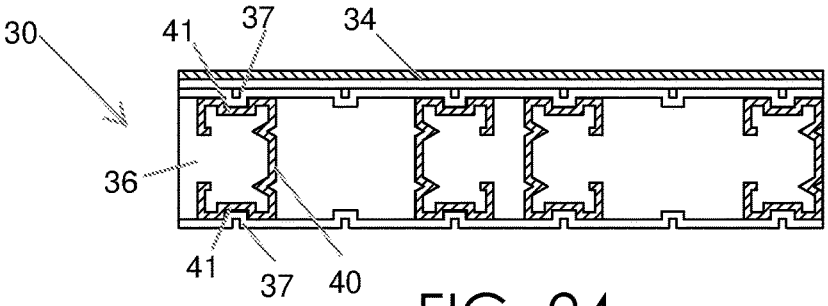
FIG. 24 is a cross-sectional view taken along line 24-24 in FIG. 21, in accordance with a non-limiting exemplary embodiment of the present disclosure.
Figure 25:
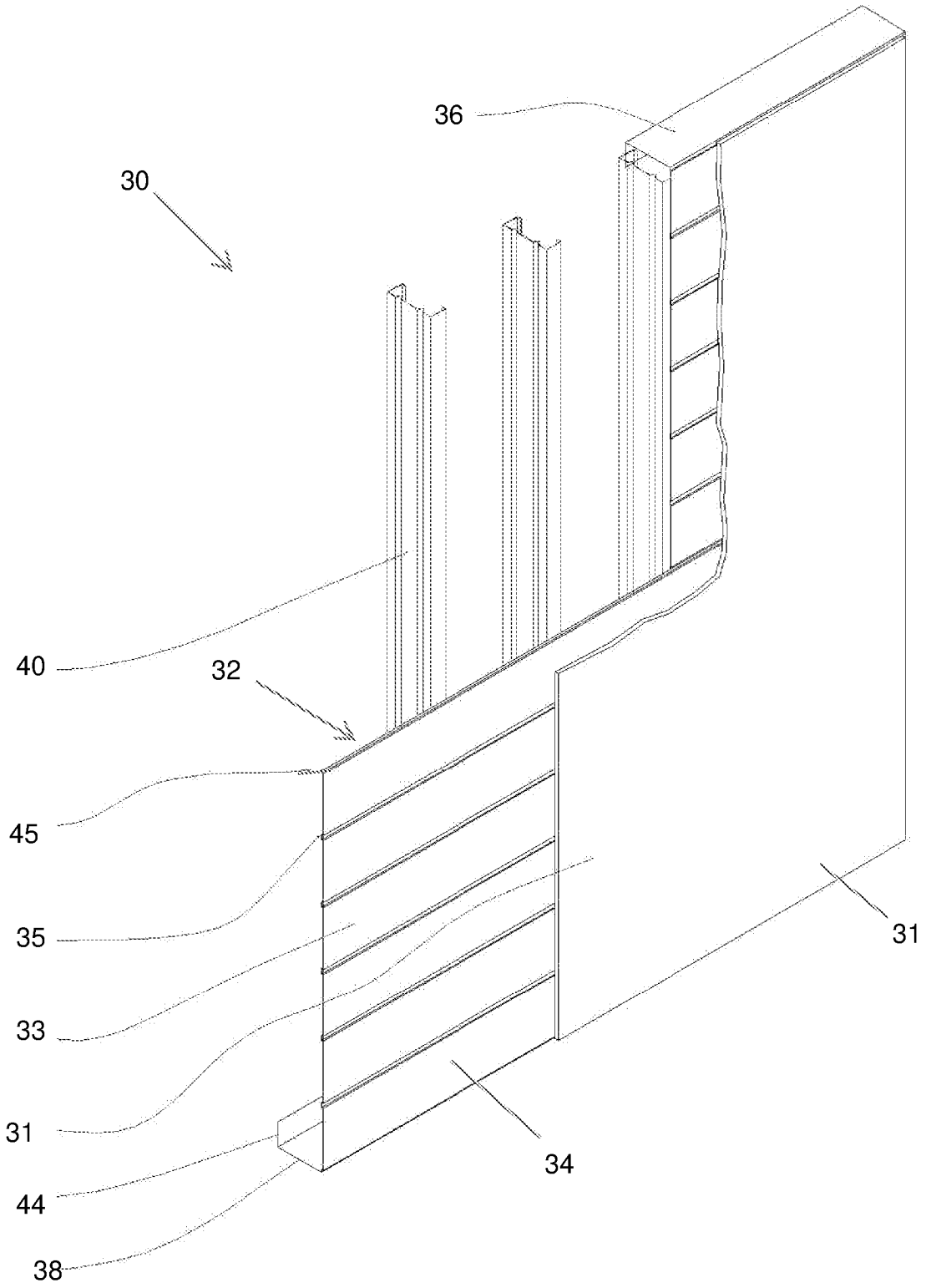
FIG. 25 is a partially exposed perspective view of a stiff wall panel assembly having a sheathing affixed to a front surface thereof, in accordance with a non-limiting exemplary embodiment of the present disclosure.
Figure 26:
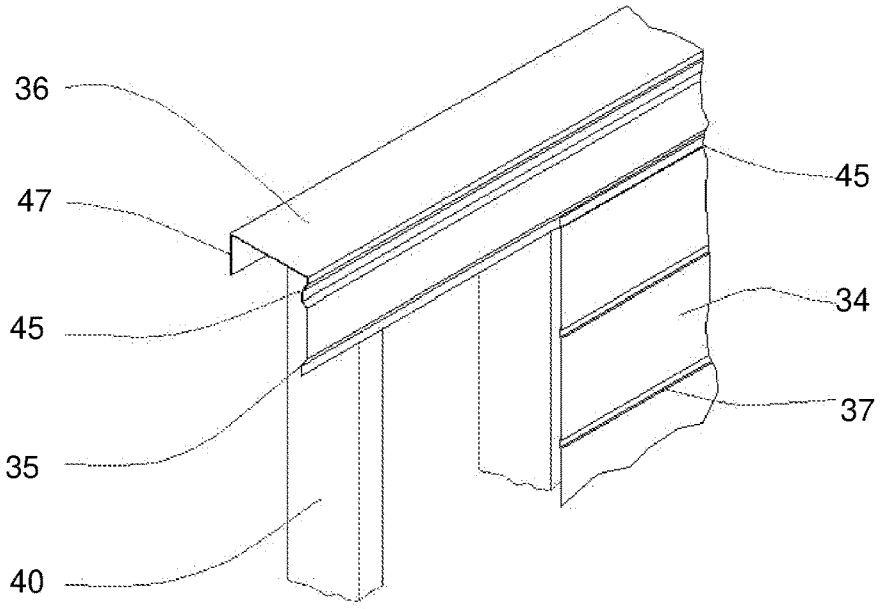
Figure 27:
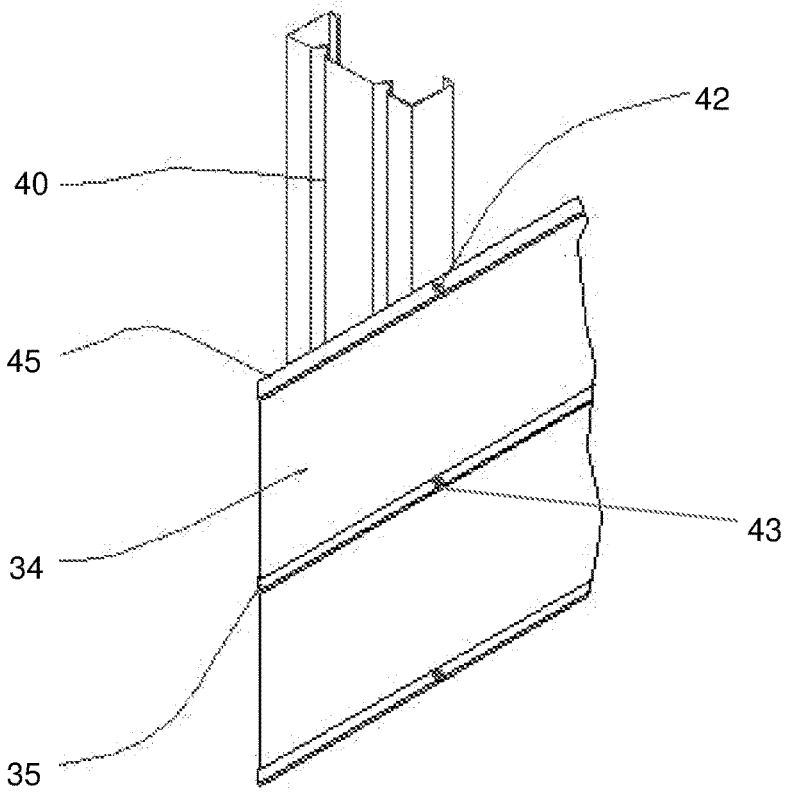

FIG. 26 is a perspective view of a stiff wall panel assembly having a portion of a wall panel extended along the top wall track, in accordance with a non-limiting exemplary embodiment of the present disclosure; and FIG. 27 is a perspective view of a stiff wall panel assembly wherein the wall panel is affixed, via a fastener, to the orthogonally oriented stud, in accordance with a non-limiting exemplary embodiment of the present disclosure.

Those skilled in the art will appreciate that the figures are not intended to be drawn to any particular scale; nor are the figures intended to illustrate every non-limiting exemplary embodiment(s) of the present disclosure. The present disclosure is not limited to any particular non-limiting exemplary embodiment(s) depicted in the figures nor the shapes, relative sizes or proportions shown in the figures.

DETAILED DESCRIPTION OF NON-LIMITING EXEMPLARY EMBODIMENT(S) OF THE PRESENT DISCLOSURE

The present disclosure will now be described more fully hereinafter with reference to the accompanying drawings, in which non-limiting exemplary embodiment(s) of the present disclosure is shown. The present disclosure may, however, be embodied in many different forms and should not be construed as limited to the non-limiting exemplary embodiment(s) set forth herein. Rather, such non-limiting exemplary embodiment(s) are provided so that this application will be thorough and complete, and will fully convey the true spirit and scope of the present disclosure to those skilled in the relevant art(s). Like numbers refer to like elements throughout the figures.

The illustrations of the non-limiting exemplary embodiment(s) described herein are intended to provide a general understanding of the structure of the present disclosure. The illustrations are not intended to serve as a complete description of all of the elements and features of the structures, systems and/or methods described herein. Other non-limiting exemplary embodiment(s) may be apparent to those of ordinary skill in the relevant art(s) upon reviewing the disclosure. Other non-limiting exemplary embodiment(s) may be utilized and derived from the disclosure such that structural, logical substitutions and changes may be made without departing from the true spirit and scope of the present disclosure. Additionally, the illustrations are merely representational are to be regarded as illustrative rather than restrictive.

One or more embodiment(s) of the disclosure may be referred to herein, individually and/or collectively, by the term "non-limiting exemplary embodiment(s)" merely for convenience and without intending to voluntarily limit the true spirit and scope of this application to any particular non-limiting exemplary embodiment(s) or inventive concept. Moreover, although specific embodiment(s) have been illustrated and described herein, it should be appreciated that any subsequent arrangement designed to achieve the same or similar purpose may be substituted for the specific embodiment(s) shown. This disclosure is intended to cover any and all subsequent adaptations or variations of other embodiment(s). Combinations of the above embodiment(s), and other embodiment(s) not specifically described herein, will be apparent to those of skill in the relevant art(s) upon reviewing the description.

References in the specification to "one embodiment(s)", "an embodiment(s)", "a preferred embodiment(s)", "an alternative embodiment(s)" and similar phrases mean that a particular feature, structure, or characteristic described in connection with the embodiment(s) is included in at least an embodiment(s) of the non-limiting exemplary embodiment(s). The appearances of the phrase "non-limiting exemplary embodiment" in various places in the specification are not necessarily all meant to refer to the same embodiment(s).

Directional and/or relationary terms such as, but not limited to, left, right, nadir, apex, top, bottom, vertical, horizontal, back, front and lateral are relative to each other and are dependent on the specific orientation of an applicable element or article, and are used accordingly to aid in the description of the various embodiment(s) and are not necessarily intended to be construed as limiting.

If used herein, "about," "generally," and "approximately" mean nearly and in the context of a numerical value or range set forth means±15% of the numerical.

If used herein, "substantially" means largely if not wholly that which is specified but so close that the difference is insignificant.

A non-limiting exemplary embodiment(s) of the present disclosure is referred to generally in the figures and is intended to provide a specially configured steel stiff wall panel assembly for providing improved resistance to shear forces, racking forces, and impact forces. It should be understood that the exemplary embodiment(s) may be used to erect many building structures, and should not be limited to any particular building structure described herein.

The non-limiting exemplary embodiment(s) is/are referred to generally in FIGS. 1-27 and is/are intended to provide a stiff wall panel assembly 30 provides an exterior sheathing 31 substrate on walls and roofs. The stiff wall panel assembly 30 is installed on the exterior face of the wall framing and or roof framing. Additional building/finish materials (e.g., sheathing 31) are then installed over the stiff wall panel assembly 30. Benefits provided by the properties of the stiff wall panel assembly 30 are: impact resistant (missile projection); resists high wind forces; provides lateral stability of the structure; conceals fasteners (eliminates fastener head projection so as not to interfere with finish materials); and provides additional vertical strength to wall assemblies which in turn allows for flexibility in framing layout.

FIGS. 1-27 disclose various embodiments of a stiff wall panel assembly 30 for a building structure. The stiff wall panel assembly 30 includes a wall panel 32 including a single, continuous, and unitary layer 33 extended along an entire surface area of the wall panel 32. Such a single, continuous, and unitary layer 33 includes a central portion 34 having a plurality of central portion ribs 35 spaced therealong, a first wall track 36 engaged with the central portion 34 and having a plurality of first ribs 37 spaced therealong, and a second wall track 38 engaged with the central portion 34 and having a plurality of second ribs 39 spaced therealong. A plurality of studs 40 are engaged with the central portion 34, the first wall track 36, and the second wall track 38. Such studs 40 have a plurality of third ribs 41 each engaged with the central portion ribs 35, the first ribs 37, and the second ribs 39. Advantageously, the first ribs 37 and the second ribs 39 each are linearly interlocked as well as linearly and slidably interfitted within the third ribs 41 of the studs 40. Advantageously, the first ribs 37 and the second ribs 39 each are parallel to the third ribs 41 of the studs 40. Notably, the first ribs 37 and the second ribs 39 each having a longitudinal length shorter than a longitudinal length of the third ribs 41 of the studs 40. Such a structural configuration yields the new, useful, and unpredicted result of improved resistance to shear forces, racking forces, and impact forces.

In a non-limiting exemplary embodiment, the first wall track 36 is oriented parallel to the second wall track 38. Such a structural configuration yields the new, useful, and unpredicted result of improved resistance to shear forces, racking forces, and impact forces.

In a non-limiting exemplary embodiment, the central portion ribs 35 are integral with the central portion 34 and linearly extended therealong. Such a structural configuration yields the new, useful, and unpredicted result of improved resistance to shear forces, racking forces, and impact forces.

In a non-limiting exemplary embodiment, the central portion ribs 35 are parallel to the first ribs 37, the second ribs 39, and the third ribs 41. Such a structural configuration yields the new, useful, and unpredicted result of improved resistance to shear forces, racking forces, and impact forces.

In a non-limiting exemplary embodiment, the central portion ribs 35 are linearly interlocked as well as linearly and slidably interfitted with the third ribs 41 of the studs 40. Such a structural configuration yields the new, useful, and unpredicted result of improved resistance to shear forces, racking forces, and impact forces.

In a non-limiting exemplary embodiment, the central portion ribs 35 are orthogonal to the first ribs 37, the second ribs 39, and the third ribs 41. Such a structural configuration yields the new, useful, and unpredicted result of improved resistance to shear forces, racking forces, and impact forces.

In a non-limiting exemplary embodiment, a plurality of fasteners 42 connected to a plurality of intersecting junctures 43 of the central portion ribs 35 and the third ribs 41 of the studs 40, respectively. Such a structural configuration yields the new, useful, and unpredicted result of improved resistance to shear forces, racking forces, and impact forces.

In a non-limiting exemplary embodiment, the central portion 34 is integral and monolithic with the first wall track 36 and the second wall track 38. Such a structural configuration yields the new, useful, and unpredicted result of improved resistance to shear forces, racking forces, and impact forces.

In a non-limiting exemplary embodiment, each of the first wall track 36 and the second wall track 38 has a single stiffening leg 44 longitudinally extended orthogonal to the studs 40 and oppositely spaced from the central portion 34. Advantageously, the first ribs 37 and the second ribs 39 are located at the single stiffening leg 44, respectively. Such a structural configuration yields the new, useful, and unpredicted result of improved resistance to shear forces, racking forces, and impact forces.

In a non-limiting exemplary embodiment, the central portion 34 is separate from and detachably coupled to each of the first wall track 36 and the second wall track 38. Such a structural configuration yields the new, useful, and unpredicted result of improved resistance to shear forces, racking forces, and impact forces.

In a non-limiting exemplary embodiment, the central portion 34 has a first tongue 45 and a second tongue 46 located at opposed perimeter edges of the central portion 34. Advantageously, each of the first tongue 45 and the second tongue 46 is rectilinear and parallel to the central portion ribs 35, respectively. Such a structural configuration yields the new, useful, and unpredicted result of improved resistance to shear forces, racking forces, and impact forces.

In a non-limiting exemplary embodiment, each of the first wall track 36 and the second wall track 38 has a pair of stiffening legs 47, 48 longitudinally extended orthogonal to the studs 40. Advantageously, a first one of the stiffening legs 47 is directly connected to the central wall panel 32 and a second one of the stiffening legs 48 is oppositely spaced from the central wall panel 32. In this manner, the first ribs 37 of the first wall track 36 and the second ribs 39 of the second wall track 38 are located at the first one 47 and the second one 48 of the stiffening legs associated with each of the first wall track 36 and the second wall track 38, respectively. Such a structural configuration yields the new, useful, and unpredicted result of improved resistance to shear forces, racking forces, and impact forces.

In a non-limiting exemplary embodiment, the stiff wall panel assembly 30 is constructed of various metal gauges (ideal range 22 to 20 gauge). Repetitive grooves (ribs 35) are rolled or bent in the material to provide rigidity and act as a fastening flange. The sides of the wall panel 32 are laid out to overlap with adjacent panels on all four sides.

In a non-limiting exemplary embodiment, the stiff wall panel assembly 30 includes a "built-in" top 36 and bottom track 38 which accepts vertical studs 40 (framing members).

In a non-limiting exemplary embodiment, the stiff wall panel assembly 30 includes individual top 36 and bottom tracks 38 which mate with a standard stiff panel sheet 32.

Referring to the FIGS. 1-27, in a non-limiting exemplary embodiment(s), the present disclosure provides the following new, useful, and unexpected benefits: track is built into panels and laid out with "S" ribs; added shear 300-400% more than plywood; non-combustible; impact resistant; greater pullout strength for sidings and finish (e.g., nail pulled out from wood panel requires about 80 lbs. Nail pulled out from steel panel 32 requires about 250-350 lbs.); seismic and wind rated for over 200 mph; bearing capacity is up to 2000 lbs loads between studs 40 and loading over studs 40 can be 8000-45,000 lbs by changing a gauge of the wall stud 40; uplift attachment plates/clips provide ten times more capacity than a screw or standard clip; cost effective; less labor; and recessed screws.

The present disclosure further provides the following additional new, useful, and unexpected benefits: impact resistant; non-combustible; shear panel; increased racking force; pre-layouts; recessed screw attachments; horizontal rib panel thermal break; increased load capacity in between studs 40; and increased capability by adding additional fasteners 42.

In a non-limiting exemplary embodiment, the present disclosure includes horizontal 0.5 inch deep ribs 35 running across the wall panel 32 with ribs 37, 39 on top and bottom lips of tracks 36, 38.

In a non-limiting exemplary embodiment, the present disclosure includes stud ribs 41 running down the wall panel 32 for flush panel.

The stiff wall panel assembly 30 includes a wall panel 32 having a centrally registered longitudinal axis and including a single, continuous, and unitary layer 33 extended along an entire surface area of the wall panel 32. Such a single, continuous, and unitary layer 33 includes a central portion 34, a first wall track 36 axially and a second wall track 38 axially opposed therefrom. The first wall track 36 and the second wall track 38 are axially offset along the centrally registered longitudinal axis and monolithically connected to the central portion 34, and a plurality of ribs 35 juxtaposed and spaced apart along the wall panel 32. Advantageously, the ribs are integral with the central portion 34 and linearly extended therealong. Notably, the first wall track 36 and the second wall track 38 are non-planar relative to the central portion 34.

In a non-limiting exemplary embodiment, the present disclosure further includes a plurality of wall studs 40 statically affixed to the wall panel 32 and statically engaged with the ribs 37, 39, a floor beam may be statically connected to the second wall track 38, a plurality of floor joists may be positioned on an existing support surface and engaged with the wall panel 32 and the floor beam, and a plurality of fasteners 42 engaged with the wall panel 32, the wall studs 40, and the floor beam, and the floor joists.

In a non-limiting exemplary embodiment, the single, continuous, and unitary layer 33 further includes a linear left edge and a linear right edge each extended along the central portion 34 and equidistantly offset from the central registered longitudinal axis.

In a non-limiting exemplary embodiment, the central portion 34 includes a plurality of planar sections 34*a* intercalated between the plurality of ribs 35 and extended along an entire longitudinal length of the ribs 35.

In a non-limiting exemplary embodiment, the wall studs 40 are statically engaged directly with the central portion 34, the first wall track 36, and the second wall track 38.

In a non-limiting exemplary embodiment, the ribs 35 protrude outwardly from an anterior face of the central portion 34.

In a non-limiting exemplary embodiment, the ribs 35 are equidistantly spaced apart.

In a non-limiting exemplary embodiment, the first wall track 36 and the second wall track 38 are integral and monolithically connected to the central portion 34.

In a non-limiting exemplary embodiment, the single, continuous, and unitary layer 33 consists of a single sheet of steel.

In a non-limiting exemplary embodiment, the wall studs 40 include a single, continuous, and unitary body including a single sheet of steel.

In a non-limiting exemplary embodiment, the ribs 35 are coextensively shaped and oriented perpendicular to the first wall track 36 and the second wall track 38.

In a non-limiting exemplary embodiment, the ribs 35 are coextensively shaped and oriented parallel to the first wall track 36 and the second wall track 38. Such ribs 35 are extended from the first wall track 36 to the second wall track 38.

In a non-limiting exemplary embodiment, each of the first wall track 36 and the second wall track 38 are L-shaped or U-shaped.

In a non-limiting exemplary embodiment, a depth of each of the first wall track 36 and the second wall track 38 is equal to a depth of the wall studs 40.

In a non-limiting exemplary embodiment, a latitudinal width of the central portion 34 is equal to a longitudinal length of the floor beam.

In a non-limiting exemplary embodiment, the ribs 35 span across an entire latitudinal width of the wall panel 32.

In a non-limiting exemplary embodiment, the wall studs 40 have axially opposed ends directly connected to the first wall track 36 and the second wall track 38.

In a non-limiting exemplary embodiment, the wall studs 40 are directly and statically affixed to the ribs 35 via the fasteners 42.

In a non-limiting exemplary embodiment, the ribs 35 are spaced apart approximately six to sixteen inches or twenty-four inches apart.

While various embodiments have been described, the description is intended to be exemplary, rather than limiting, and it is understood that many more embodiments and implementations are possible that are within the scope of the embodiments. Although many possible combinations of features are shown in the accompanying figures and discussed in this detailed description, many other combinations of the disclosed features are possible. Any feature of any embodiment may be used in combination with or substituted for any other feature or element in any other embodiment unless specifically restricted. Therefore, it will be understood that any of the features shown and/or discussed in the present disclosure may be implemented together in any suitable combination. Accordingly, the embodiments are not to be restricted except in light of the attached claims and their equivalents. Also, various modifications and changes may be made within the scope of the attached claims.

While the foregoing has described what are considered to be the best mode and/or other examples, it is understood that various modifications may be made therein and that the subject matter disclosed herein may be implemented in various forms and examples, and that the teachings may be applied in numerous applications, only some of which have been described herein. It is intended by the following claims to claim any and all applications, modifications and variations that fall within the true scope of the present teachings.

Unless otherwise stated, all measurements, values, ratings, positions, magnitudes, sizes, and other specifications that are set forth in this specification, including in the claims that follow, are approximate, not exact. They are intended to have a reasonable range that is consistent with the functions to which they relate and with what is customary in the art to which they pertain.

The scope of protection is limited solely by the claims that now follow. That scope is intended and should be interpreted to be as broad as is consistent with the ordinary meaning of the language that is used in the claims when interpreted in light of this specification and the prosecution history that follows and to encompass all structural and functional equivalents. Notwithstanding, none of the claims are intended to embrace subject matter that fails to satisfy the requirement of Sections 101, 102, or 103 of the Patent Act, nor should they be interpreted in such a way. Any unintended embracement of such subject matter is hereby disclaimed.

Except as stated immediately above, nothing that has been stated or illustrated is intended or should be interpreted to cause a dedication of any component, step, feature, object, benefit, advantage, or equivalent to the public, regardless of whether it is or is not recited in the claims.

It will be understood that the terms and expressions used herein have the ordinary meaning as is accorded to such terms and expressions with respect to their corresponding respective areas of inquiry and study except where specific meanings have otherwise been set forth herein. Relational terms such as first and second and the like may be used solely to distinguish one entity or action from another without necessarily requiring or implying any actual such relationship or order between such entities or actions. The terms "comprises," "comprising," or any other variation thereof, are intended to cover a non-exclusive inclusion, such that a process, method, article, or apparatus that comprises a list of elements does not include only those elements but may include other elements not expressly listed or inherent to such process, method, article, or apparatus. An element proceeded by "a" or "an" does not, without further constraints, preclude the existence of additional identical elements in the process, method, article, or apparatus that comprises the element.

The Abstract of the Disclosure is provided to allow the reader to quickly ascertain the nature of the technical disclosure. It is submitted with the understanding that it will not be used to interpret or limit the scope or meaning of the claims. In addition, in the foregoing Detailed Description, it can be seen that various features are grouped together in various examples for the purpose of streamlining the disclosure. This method of disclosure is not to be interpreted as reflecting an intention that the claims require more features than are expressly recited in each claim. Rather, as the following claims reflect, inventive subject matter lies in less than all features of a single disclosed example. Thus, the following claims are hereby incorporated into the Detailed Description, with each claim standing on its own as a separately claimed subject matter.

What is claimed as new and what is desired to secure by Letters Patent of the United States is:

1. A stiff wall panel assembly for a building structure, comprising:

a wall panel including a single, continuous, and unitary layer extended along an entire surface area of said wall panel, said single, continuous, and unitary layer including a central portion having a plurality of central portion ribs spaced therealong, a first wall track engaged with said central portion and having a plurality of first ribs spaced therealong, and a second wall track engaged with said central portion and having a plurality of second ribs spaced therealong; and a plurality of studs engaged with said central portion, said first wall track, and said second wall track, said studs having a plurality of third ribs each engaged with said central portion ribs, said first ribs, and said second ribs;

wherein said first ribs and said second ribs each are linearly interlocked as well as linearly and slidably interfitted within said third ribs of said studs.

2. The stiff wall panel assembly of claim 1, wherein said first wall track is oriented parallel to said second wall track.

3. The stiff wall panel assembly of claim 2, wherein said central portion ribs are integral with said central portion and linearly extended therealong.

4. The stiff wall panel assembly of claim 3, wherein said central portion ribs are parallel to said first ribs, said second ribs, and said third ribs.

5. The stiff wall panel assembly of claim 4, wherein said central portion ribs are linearly interlocked as well as linearly and slidably interfitted with said third ribs of said studs.

6. The stiff wall panel assembly of claim 3, wherein said central portion ribs are orthogonal to said first ribs, said second ribs, and said third ribs.

7. The stiff wall panel assembly of claim 6, further comprising: a plurality of fasteners connected to a plurality of intersecting junctures of said central portion ribs and said third ribs of said studs, respectively.

8. The stiff wall panel assembly of claim 3, wherein said central portion is integral and monolithic with said first wall track and said second wall track.

9. The stiff wall panel assembly of claim 8, wherein each of said first wall track and said second wall track having a single stiffening leg longitudinally extended orthogonal to said studs and oppositely spaced from said central portion, wherein said first ribs and said second ribs are located at said single stiffening leg, respectively.

10. The stiff wall panel assembly of claim 3, wherein said central portion is separate from and detachably coupled to each of said first wall track and said second wall track.

11. The stiff wall panel assembly of claim 10, wherein said central portion has a first tongue and a second tongue located at opposed perimeter edges of said central portion, wherein each of said first tongue and said second tongue is rectilinear and parallel to said central portion ribs, respectively.

12. The stiff wall panel assembly of claim 11, wherein each of said first wall track and said second wall track has a pair of stiffening legs longitudinally extended orthogonal to said studs, wherein a first one of said stiffening legs is directly connected to said central wall panel and a second one of said stiffening legs is oppositely spaced from said central wall panel, wherein said first ribs of said first wall track and said second ribs of said second wall track are located at said first one and said second one of said stiffening legs associated with each of said first wall track and said second wall track, respectively.

13. A stiff wall panel assembly for a building structure, comprising:

a wall panel including a single, continuous, and unitary layer extended along an entire surface area of said wall panel, said single, continuous, and unitary layer including a central portion having a plurality of central portion ribs spaced therealong, a first wall track engaged with said central portion and having a plurality of first ribs spaced therealong, and a second wall track engaged with said central portion and having a plurality of second ribs spaced therealong; and a plurality of studs engaged with said central portion, said first wall track, and said second wall track, said studs having a plurality of third ribs each engaged with said central portion ribs, said first ribs, and said second ribs;

wherein said first ribs and said second ribs each are linearly interlocked as well as linearly and slidably interfitted within said third ribs of said studs;

wherein said first ribs and said second ribs each are parallel to said third ribs of said studs.

14. A stiff wall panel assembly for a building structure, comprising:

a wall panel including a single, continuous, and unitary layer extended along an entire surface area of said wall panel, said single, continuous, and unitary layer including a central portion having a plurality of central portion ribs spaced therealong, a first wall track engaged with said central portion and having a plurality of first ribs spaced therealong, and a second wall track engaged with said central portion and having a plurality of second ribs spaced therealong; and a plurality of studs engaged with said central portion, said first wall track, and said second wall track, said studs having a plurality of third ribs each engaged with said central portion ribs, said first ribs, and said second ribs;

wherein said first ribs and said second ribs each are linearly interlocked as well as linearly and slidably interfitted within said third ribs of said studs;

wherein said first ribs and said second ribs each are parallel to said third ribs of said studs;

wherein said first ribs and said second ribs each having a longitudinal length shorter than a longitudinal length of said third ribs of said studs.

* * * * *